United States Patent [19]

Inomata et al.

[11] 4,225,339

[45] Sep. 30, 1980

[54] AMORPHOUS ALLOY OF HIGH MAGNETIC PERMEABILITY

[75] Inventors: Koichiro Inomata, Yokohama; Senji Shimanuki, Kawasaki; Michio Hasegawa, Yokohama, all of Japan

[73] Assignee: Tokyo Shibaura Denki Kabushiki Kaisha, Kawasaki, Japan

[21] Appl. No.: 969,960

[22] Filed: Dec. 15, 1978

[30] Foreign Application Priority Data

| | | | |
|---|---|---|---|
| Dec. 28, 1977 | [JP] | Japan | 52-157274 |
| Feb. 13, 1978 | [JP] | Japan | 53-14167 |
| Feb. 13, 1978 | [JP] | Japan | 53-14168 |

[51] Int. Cl.[2] ..... C22C 38/10; C22C 38/12

[52] U.S. Cl. ..... 75/122; 75/123 B; 75/134 F; 75/170; 148/31.55

[58] Field of Search ..... 148/31.55; 75/122, 134 F, 75/170, 123 B

[56] References Cited

U.S. PATENT DOCUMENTS

| | | | |
|---|---|---|---|
| 3,856,513 | 12/1974 | Chen et al. | 75/170 |
| 4,056,411 | 11/1977 | Chen et al. | 75/170 |
| 4,059,462 | 11/1977 | Masumoto et al. | 148/31.55 |
| 4,067,732 | 1/1978 | Ray | 75/170 |
| 4,152,144 | 5/1979 | Hasegawa et al. | 75/122 |

FOREIGN PATENT DOCUMENTS

| | | |
|---|---|---|
| 51-73920 | 6/1976 | Japan . |
| 51-77899 | 7/1976 | Japan . |

*Primary Examiner*—L. Dewayne Rutledge
*Assistant Examiner*—Upendra Roy
*Attorney, Agent, or Firm*—Oblon, Fisher, Spivak, McClelland & Maier

[57] ABSTRACT

An amorphous alloy of high magnetic permeability, having a general formula;

$$(T_yNb_xA_{1-x-y})_{100-z}X_z$$

where,

"A" is at least one kind selected from the group consisting of 0.5 to 10 atomic % of V, Ta, Ti, Zr, Cr, Mo, W and 0.5 to 30 atomic % of Ni based on the total amount of T, Nb and A, "T" is at least one element selected from the group of Fe and Co, "X" is B or B+Si, the amount of Si being at most 25 atomic % based on the total amount of the alloy, "x" ranges between 0.005 and 0.1, "y" ranges between 0.5 and 0.99, and "z" ranges between 15 and 35, with the proviso of $0.005 \leqq 1-x-y \leqq 0.4$.

9 Claims, 7 Drawing Figures

AMORPHOUS ALLOY OF HIGH MAGNETIC PERMEABILITY

BACKGROUND OF THE INVENTION

This invention relates to an amorphous alloy of high magnetic permeability suitable for forming a video or audio magnetic head, a magnetic shielding device, a transformer and other magnetic devices.

Conventional magnetic materials of high magnetic permeability suitable for forming a magnetic head, a magnetic shielding device, a transformer, etc. include, for example, crystalline alloys of Fe-Si system, Fe-Ni system, Fe-Al system and Fe-Si-Al system. Certainly, these conventional magnetic materials are satisfactory to some extent, but leave room for further improvements in magnetic properties, workability, etc.

Fe-Si alloy, which is widely used for forming a core of transformer and motor, has a magnetic permeability of at most about 500.

Fe-Ni alloy known as permalloy, particularly, permalloy containing 78 atomic % of Ni has a high magnetic permeability, but is insufficient in hardness, giving rise to difficulty in wear resistance when used for forming a magnetic head. Incidentally, a general method of producing a magnetic head comprises laminating a magnetic material, followed by synthetic resin molding. What should be noted is that the molding step causes a marked reduction in magnetic permeability of the magnetic material.

Some of Fe-Al alloys and Fe-Al-Si alloys have a high magnetic permeability, but are brittle, giving rise to difficulty in workability.

Recently, excellent magnetic and mechanical properties have been found in amorphous alloys. Unlike an ordinary cyrstalline alloy, an amorphous alloy does not have a periodicity in crystal structure. Various methods of producing an amorphous alloy are known to the art including, for example, vapor deposition, electrodeposition, electroless plating, sputtering and liquid quenching method. In particular, the liquid quenching method permits producing a bulky amorphous alloy having a good mechanical strength, hardness and flexibility in constrast to a thin film of an amorphous alloy obtained by the other mehtods mentioned above. Certainly, the bulky amorphous alloy is suitable for forming a magnetic head, the core of a transformer, a magnetic shielding device, etc. But, an amorphous alloy obtained by quenching is generally low in magnetic permeability, rendering it necessary to further apply heat treatment for increasing the magnetic permeability.

It has also been found recently that an amorphous alloy of Co-Fe-Si-B system is substantially free from magnetostriction and is high in magnetic permeability where the atomic ratio of Co to Fe is about 94:6. However, the range of mixing ratios of the component metals which gives a high magnetic permeability to an obtainable alloy by quenching is very narrow rendering it unsatisfactory in reproducibility. Such an alloy is also insufficient in hardness and poor in temperature stability.

It should also be noted that a magnetic material is exposed to high temperatures in some cases in the manufacturing step of a magnetic device or during the use of the produced magnetic device. For example, a magnetic material is heated to as high as about 150° C. in a step of producing a magnetic head. In such a case, it is important that the deterioration of magnetic properties such as magnetic permeability should be prevented as much as possible. However, the deterioration mentioned is so much in the conventional amorphous alloy as to render the alloy unsuitable for practical use.

SUMMARY OF THE INVENTION

An object of this invention is to provide an amorphous alloy of high magnetic permeability and magnetic flux density, which has a high hardness, exhibits excellent mechanical properties, and is satisfactory in reproducibility and thermal stability.

According to this invention, there is provided an amorphous alloy of high magnetic permeability, having a general formula;

$$(T_yNb_xA_{1-x-y})_{100-z}X_z$$

where,

"A" is at least one kind selected from the group consisting of 0.5 to 10 atomic % of V, Ta, Ti, Zr, Cr, Mo, W and 0.5 to 30 atomic % of Ni based on the total amount of T, Nb and A.

"T" is at least one element selected from the group of Fe and Co,

"X" is B or B+Si, the amount of Si being at most 25 atomic % based on the total amount of the alloy, "x" ranges between 0.005 and 0.1, "y" ranges between 0.5 and 0.99, "z" ranges between 15 and 35, and "1−x−y" ranges between 0.005 and 0.4.

DETAILED DESCRIPTION OF THE INVENTION

Figure 1:
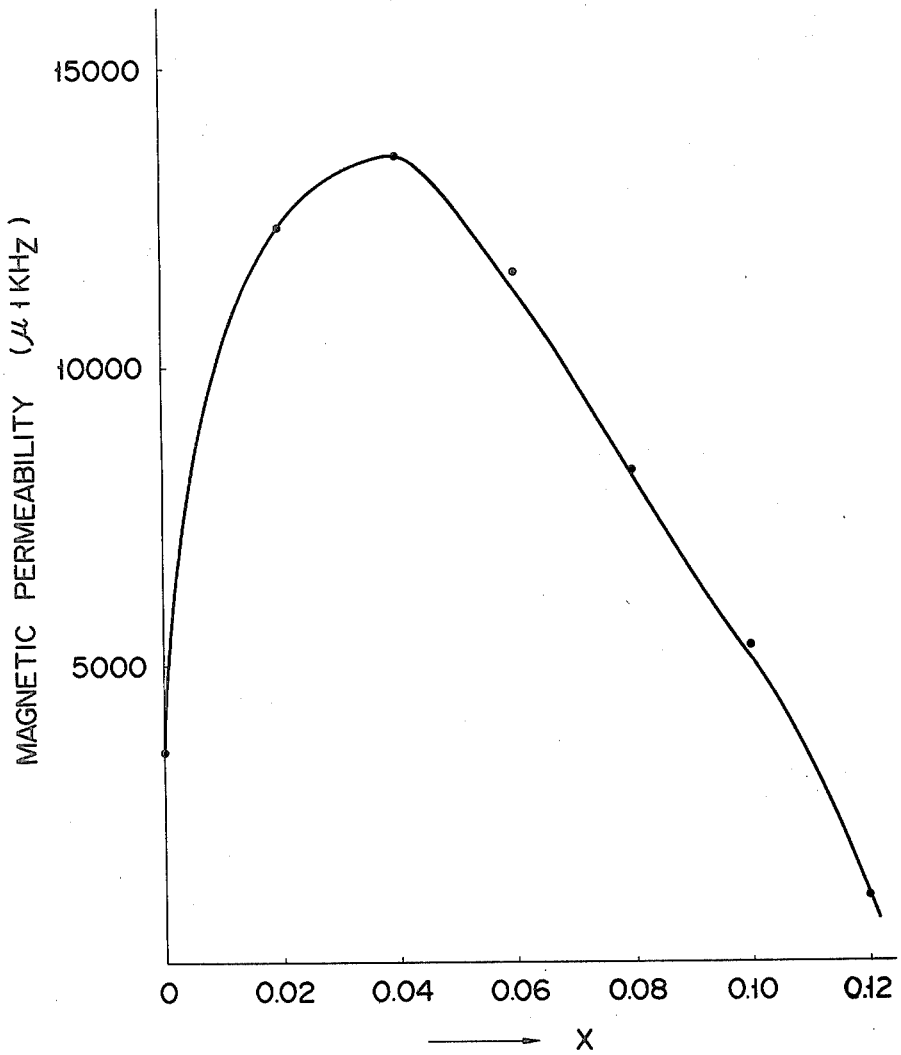
FIG. 1 is a graph showing the effect of Nb on the magnetic permeability of the alloy of this invention.

The amorphous alloy of high magnetic permeability according to this invention is represented by a general formula;

$$(T_yNb_xA_{(1-x-y)})_{100-z}X_z$$

where,

"T" is at least one element selected from the group of Fe and Co,

"A" is at least one kind selected from the group consisting of 0.5 to 10 atomic % of V, Ta, Ti, Zr, Cr, Mo, W and 0.5 to 30 atomic % of Ni based on the total amount of T, Nb and A, "X" is B or B+Si, the amount of Si being at most 25 atomic % based on the total amount of the alloy, "x" ranges between 0.005 and 0.1, "y" ranges between 0.5 and 0.99, and "z" ranges between 15 and 35, with the proviso of $0.005 \leqq 1-x-y \leqq 0.4$.

The alloy of the above-noted general formula can be classified into the following three types.

A first type of the alloy is represented by a general formula;

$$(T_{1-a-b}Nb_aNi_b)_{100-z}X_z \quad (1)$$

where,

"T" is at least one element selected from the group of Co and Fe,

"X" is B or B+Si, the amount of Si being at most 25 atomic % based on the total amount of the alloy, "a" ranges between 0.005 and 0.10, "b" ranges between 0.005 and 0.30, and "z" ranges between 15 and 35.

Where the formula (1) is converted to $$(Co_{1-a-b-c}Fe_cNb_aNi_b)_{100-z'-z''}Si_{z'}B_{z''}$$

it is preferred to allow the amount of each component of the alloy to fall within the range specified below;

$$0.01 \leqq a \leqq 0.10;\ 0.01 \leqq b \leqq 0.15;\ 0.04 \leqq c \leqq 0.09;$$

$$5 \leqq Z' \leqq 17;\ 8 \leqq Z'' \leqq 17;\ 20 \leqq Z'+Z'' \leqq 28.$$

A second type of the alloy is represented by a general formula;

$$(T_{1-d-e}Nb_dM_e)_{100-z}X_z \quad (2)$$

where,

"T" is at least one element selected from the group of Co and Fe,

"M" is at least one element selected from the group of V, Ta, Ti, Zr, Cr, Mo and W, "X" is B or B+Si, the amount of Si being at most 25 atomic % based on the total amount of the alloy, "d" ranges between 0.005 and 0.10, "e" ranges between 0.005 and 0.10, and "z" ranges between 15 and 35.

The alloy is enabled to exhibit prominent magnetic and mechanical properties particularly where the component T consists of both Fe and Co and the amount of Fe falls within the range of from 3 to 8 atomic % based on the total amount of Co, Fe, Nb and the component M.

A third type of the alloy is represented by a general formula;

$$(T_{1-f-g-h}Ni_fNb_gM_h)_{100-z}X_z \quad (3)$$

where,

"T" is at least one element selected from the group of Fe and Co,

"M" is at least one element selected from the group of V, Ta, Ti, Zr, Cr, Mo and W, "X" is B or B+Si, the amount of Si being at most 25 atomic % based on the total amount of the alloy, "f" ranges between 0.005 and 0.30, "g" ranges between 0.005 and 0.10, "h" ranges between 0.005 and 0.10, and "z" ranges between 15 and 35.

The alloy is enabled to exhibit prominent magnetic and mechanical properties particularly where "T" consists of both Fe and Co and the amount of Fe ranges between 4 and 15 atomic % based on the total amount of Co, Fe, Ni, Nb and the component M.

For forming, particularly, a magnetic head, a magnetic shielding device, etc., the magnetic material should desirably have a magnetic flux density of at least 6,000 G. In this sense, the Ni content of the amorphous alloy of this invention, i.e., the values of "b" and "f" of the general formulae (1) and (3), respectively, should be at most 0.02 so as to enable the alloy to exhibit a high magnetic flux density.

The amorphous alloy of this invention also exhibits a high thermal stability in addition to high magnetic permeability and magnetic flux density.

In the alloy of this invention, the component X, i.e., B or B+Si, serves to allow the alloy to be noncrystalline in structure. As seen from the general formulae, the amount of component X is defined to fall within the range of between 15 and 35 atomic % based on the total amount of the alloy. Further, where Si is used together with B, the amount of Si is defined not to exceed 25 atomic % based on the total amount of the alloy. If the amount of component X does not fall within the scope mentioned above, it is difficult to produce an amorphous alloy. In addition, the produced alloy fails to exhibit a high magnetic permeability.

Niobium (Nb) is indispensable for obtaining an alloy having a high magnetic permeability under rapidly cooled state. The Nb content specified in this invention ranges between 0.5 and 10 atomic % based on the total amount of the components T, A and Nb. If the Nb content is less than 0.5 atomic %, the produced alloy does not have a sufficiently high magnetic permeability. In addition, it is impossible to decrease sufficiently the coercive force (Hc) of the alloy. On the other hand, Nb exceeding 10 atomic % renders the produced alloy so brittle that the alloy can not be put to practical use. Appended FIG. 1 shows the relationship between the Nb content (x) and the magnetic permeability ($\mu$ 1 KHz) in an alloy of $(Co_{0.92-x}Fe_{0.06}Ni_{0.02}Nb_x)_{75}Si_{10}B_{15}$. It is clearly seen that the alloy containing 0.5 to 10 atomic % of Nb based on the total amount of Co, Fe, Ni and Nb exhibits a sufficiently high magnetic permeability.

Where both Co and Fe are used as the component T, a preferred range of Fe content slightly varied depending on the kinds of other components. In the alloy of general formula (1), the Fe content should range between 1 and 10 atomic % based on the total amount of Co, Fe, Ni and Nb. In general formula (2), the Fe content should range between 3 and 8 atomic % based on the total amount of Co, Fe, Nb and the component M. On the other hand, the perferred Fe content for general formula (3) ranges between 4 and 15 atomic % based on the total amount of Co, Fe, Ni, Nb and the component M.

Figure 2:
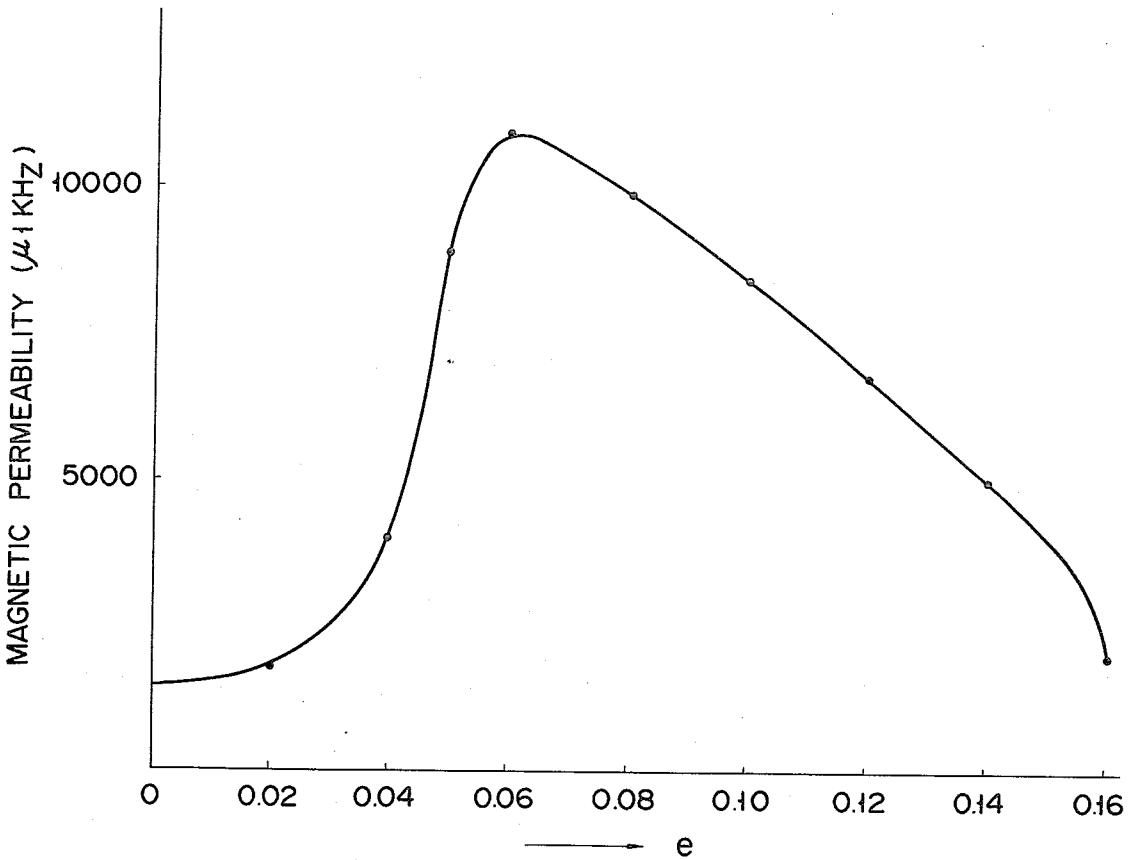
FIGS. 2 and 3 are graphs each showing the effect of Fe on the magnetic permeability of the alloy of this invention.
Figure 3:
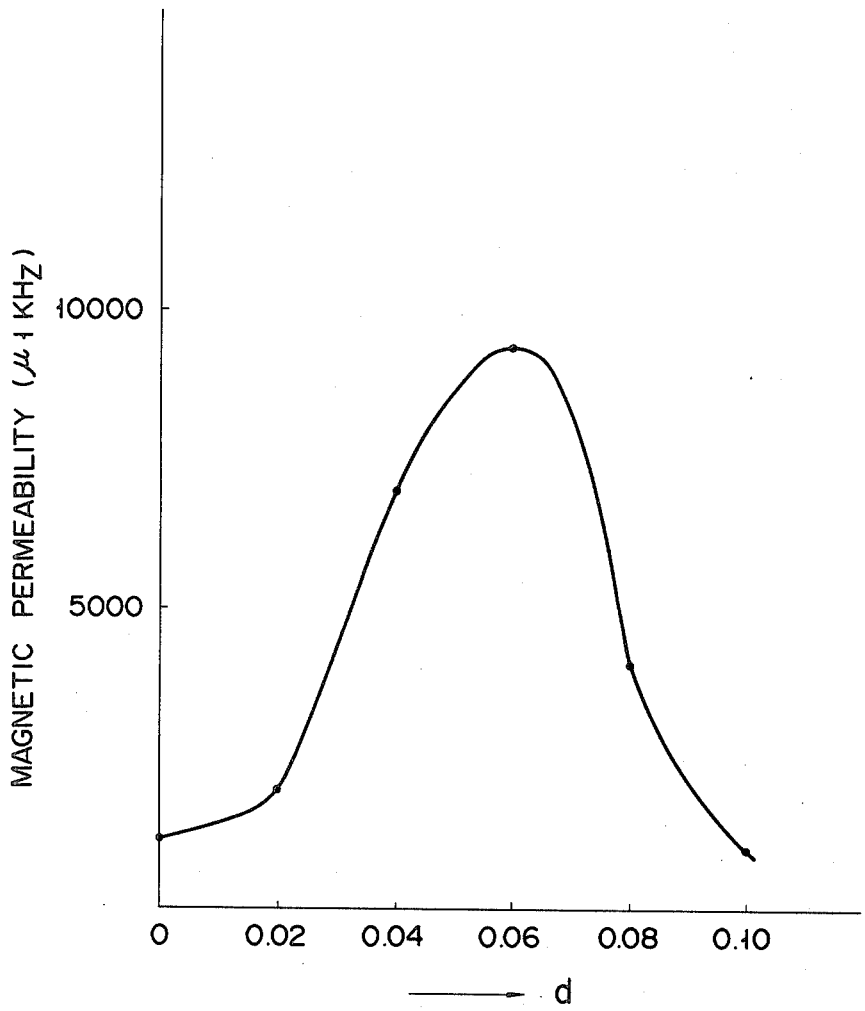

FIG. 2 shows the effect of the Fe content (e) on the magnetic permeability ($\mu$ 1 KHz) of an alloy of $(Co_{0.96-e}Fe_eNi_{0.02}Nb_{0.01}Ta_{0.01})_{75}Si_{10}B_{15}$. On the other hand, FIG. 3 shows the effect of the Fe content (d) on the magnetic permeability ($\mu$ 1 KHz) of an alloy of $(Co_{0.98-d}Fe_dNb_{0.01}Ta_{0.01})_{75}Si_{10}B_{15}$.

General formulae (2) and (3) show that the amount of component M should range between 0.5 and 10 atomic % based on the total amount of Nb, Ni and the components T and M. The M content lower than 0.5 atomic % fails to enable the produced alloy to exhibit a sufficiently high magnetic permeability and to bear a sufficiently decreased coercive force. On the other hand, the component M exceeding 10 atomic % causes the produced alloy to be very brittle. In addition, a sharp decrease of magnetic permeability and an increase of coercive force are caused by an excessive amount of the component M.

Figure 4:
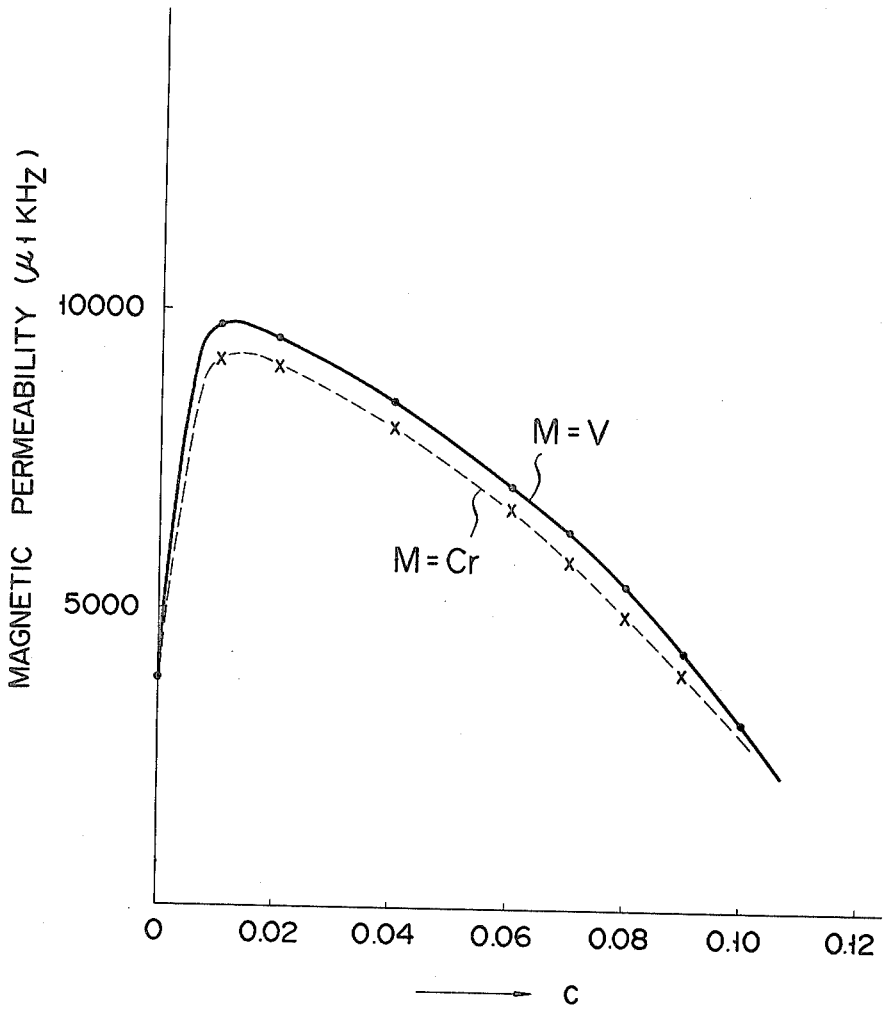
FIGS. 4 and 5 are graphs each showing the effect of the component M on the magnetic permeability of the alloy of this invention.
Figure 5:
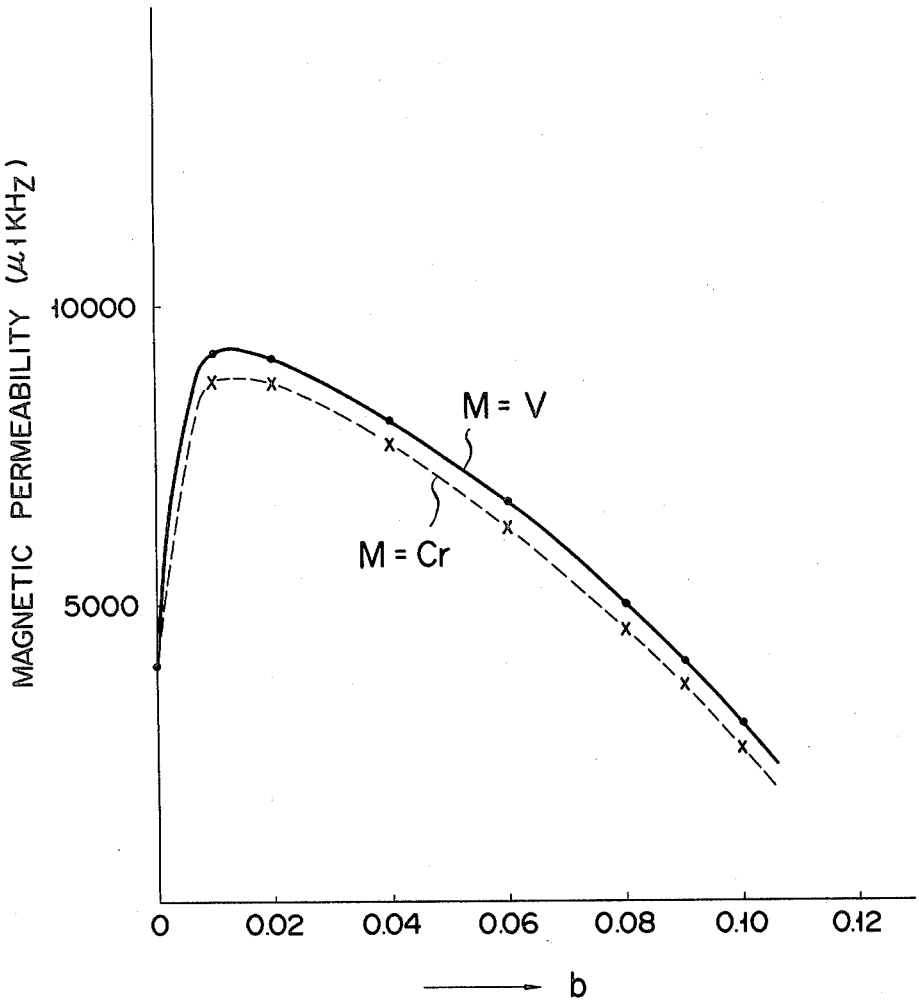

FIG. 4 shows the effect of the M content (c) on the magnetic permeability of an alloy of $(Fe_{0.06}Co_{0.91-c}Ni_{0.02}Nb_{0.01}M_c)_{75}Si_{10}B_{15}$. Likewise, FIG. 5 shows the effect of the M content (b) on the magnetic permeability of an alloy of $(Fe_{0.06}Co_{0.93-b}Nb_{0.01}M_b)_{75}Si_{10}B_{15}$. It is clearly seen from FIGS. 4 and 5 that a suitable amount of the component M ranges between 0.5 and 10 atomic % based on the total amount of Fe, Co, Ni, Nb and M.

Figure 6:
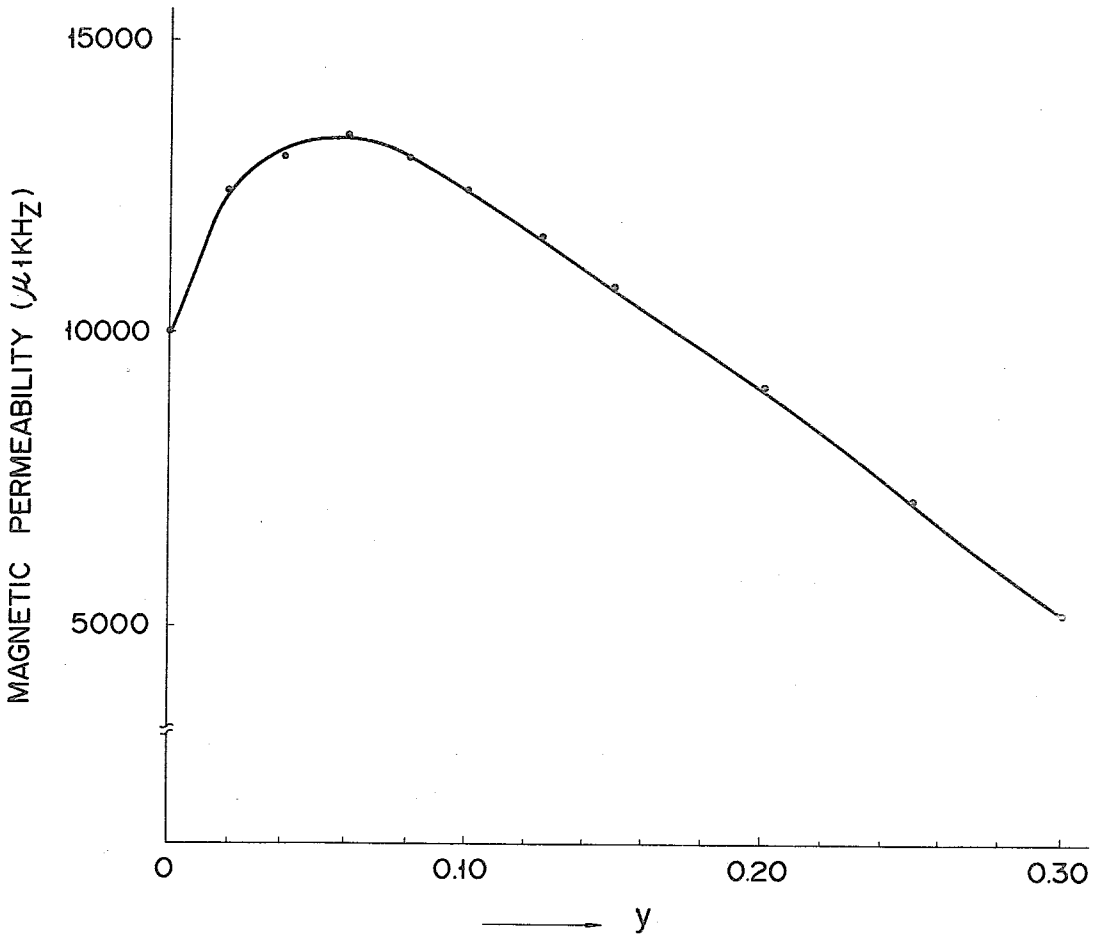
FIG. 6 is a graph showing the effect of Ni on the magnetic permeability of the alloy of this invention.

Each of general formulae (1) and (3) shows that a preferred Ni content ranges between 0.5 and 30 atomic % based on the total amount of Ni, Nb and the components T and M. This is substantiated by FIG. 6 showing the effect of the Ni content (y) on the magnetic permeability of an alloy of $(Co_{0.92-y}Fe_{0.06}Ni_yNb_{0.02})_{75}Si_{10}B_{15}$.

Described in the following are Examples of this invention.

EXAMPLE A

Amorphous alloys of various compositions, i.e., Examples 1 to 38 and controls 1 to 7, were produced by a rolling and quenching method. A molten alloy was ejected from a quartz nozzle under argon gas pressure into a small clearance between a pair of rolls rotating at high speed in opposite directions so as to cool rapidly the alloy. The resultant alloy sample was of a ribbon shape sized 2mm in width, 40μ in thickness and about 10 m in length. The rotation speed of the rolls was 3,000 rpm for Examples 1 to 18, 4,000 rpm for Examples 19 to 27, 4,500 rpm for Examples 28 to 36 and 3,000 rpm for Controls 1 to 7. On the other hand, the argon gas pressure was set at 1.6 atms for every sample.

It was confirmed by X-ray diffractometry that all the alloy samples were completely noncrystalline in structure.

Each of the samples thus obtained was wound 20 times around an alumina core having a diameter of 21 mm and subjected to a magnetic permeability test using a maxwell bridge under 1 to 100 KHz and a transformer bridge under 1 to 10 MHz. Further, the coercive force (Hc) of the alloy sample was measured by a direct current B-H tracer. Still further, the Vickers hardness (Hv) of the sample was measured by using a micro Vickers hardness meter equipped with a weight of 500 g. The following table shows the measured values of the magnetic permeability, coercive force and Vickers hardness of the sample obtained by quenching. Incidentally, the symbol "$B_{10}$" shown in the following table denotes the magnetic flux density under a magnetic field having a magnetic intensity of 10 oersted:

| | | PROPERTIES OF ALLOY | | | |
|---|---|---|---|---|---|
| Sample | Composition | Permeability μ 1KHz | Coercive Force Hc (Oe) | Hardness Hv | Magnetic Flux Density $B_{10}$(G) |
| Example 1 | $(Co_{0.92}Fe_{0.06}Nb_{0.01}Ni_{0.01})_{75}Si_{10}B_{15}$ | 9,750 | 0.014 | 980 | 8,000 |
| Example 2 | $(Co_{0.96}Ni_{0.02}Nb_{0.02})_{70}Si_{10}B_{20}$ | 2,900 | 0.024 | 850 | 7,700 |
| Example 3 | $(Co_{0.94}Fe_{0.04}Ni_{0.01}Nb_{0.01})_{70}Si_{10})B_{20}$ | 3,800 | 0.022 | 980 | 6,100 |
| Example 4 | $(Co_{0.94}Fe_{0.04}Ni_{0.01}Nb_{0.01})_{75}Si_{10}B_{15}$ | 5,300 | 0.020 | 960 | 7,800 |
| Example 5 | $(Co_{0.92}Fe_{0.04}Ni_{0.02}Nb_{0.02})_{80}B_{20}$ | 3,800 | 0.025 | 940 | 8,500 |
| Example 6 | $(Co_{0.90}Fe_{0.06}Ni_{0.02}Nb_{0.02})_{75}Si_{10}B_{15}$ | 12,000 | 0.013 | 980 | 7,600 |
| Example 7 | $(Co_{0.88}Fe_{0.06}Ni_{0.02}Nb_{0.04})_{75}Si_{10}B_{15}$ | 13,500 | 0.012 | 1,020 | 7,000 |
| Example 8 | $(Co_{0.86}Fe_{0.06}Ni_{0.02}Nb_{0.06})_{75}Si_{10}B_{15}$ | 11,600 | 0.013 | 1,100 | 6,600 |
| Example 9 | $(Co_{0.84}Fe_{0.06}Ni_{0.02}Nb_{0.08})_{75}Si_{10}B_{15}$ | 8,200 | 0.015 | 1,200 | 6,300 |
| Example 10 | $(Co_{0.82}Fe_{0.06}Ni_{0.02}Nb_{0.10})_{75}Si_{10}B_{15}$ | 5,300 | 0.016 | 1,250 | 6,100 |
| Example 11 | $(Co_{0.86}Fe_{0.10}Ni_{0.02}Nb_{0.02})_{75}Si_{10}B_{15}$ | 4,200 | 0.022 | 1,000 | 8,200 |
| Example 12 | $(Co_{0.84}Fe_{0.12}Ni_{0.02}Nb_{0.02})_{75}Si_{10}B_{15}$ | 4,000 | 0.022 | 1,050 | 8,400 |
| Example 13 | $(Co_{0.78}Fe_{0.08}Ni_{0.10}Nb_{0.04})_{70}Si_{10}B_{20}$ | 4,400 | 0.021 | 1,050 | 5,900 |
| Example 14 | $(Co_{0.73}Fe_{0.08}Ni_{0.15}Nb_{0.04})_{72}Si_{10}B_{18}$ | 4,500 | 0.022 | 1,050 | 5,800 |
| Example 15 | $(Co_{0.68}Fe_{0.08}Ni_{0.20}Nb_{0.04})_{75}Si_{10}B_{15}$ | 4,100 | 0.024 | 1,000 | 5,800 |
| Example 16 | $(Co_{0.58}Fe_{0.08}Ni_{0.30}Nb_{0.04})_{75}Si_{10}B_{15}$ | 4,000 | 0.024 | 980 | 5,000 |
| Example 17 | $(Co_{0.74}Fe_{0.20}Ni_{0.03}Nb_{0.03})_{75}Si_{10}B_{15}$ | 2,100 | 0.029 | 1,050 | 8,800 |
| Example 18 | $(Fe_{0.96}Ni_{0.02}Nb_{0.02})_{75}Si_{10}B_{15}$ | 1,700 | 0.040 | 1,000 | 15,000 |
| Example 19 | $(Co_{0.90}Fe_{0.06}Ni_{0.02}Nb_{0.01}Cr_{0.01})_{75}Si_{10}B_{15}$ | 9,200 | 0.012 | 950 | 7,500 |
| Example 20 | $(Co_{0.90}Fe_{0.06}Ni_{0.02}Nb_{0.01}Ta_{0.01})_{75}Si_{10}B_{15}$ | 10,800 | 0.013 | 980 | 7,700 |
| Example 21 | $(Co_{0.90}Fe_{0.06}Ni_{0.02}Nb_{0.01}Ti_{0.01})_{75}Si_{10}B_{15}$ | 8,200 | 0.014 | 950 | 7,600 |
| Example 22 | $(Co_{0.90}Fe_{0.06}Ni_{0.02}Nb_{0.01}Zr_{0.01})_{75}Si_{10}B_{15}$ | 8,200 | 0.014 | 950 | 7,600 |
| Example 23 | $(Co_{0.90}Fe_{0.06}Ni_{0.02}Nb_{0.01}V_{0.01})_{75}Si_{10}B_{15}$ | 9,800 | 0.011 | 980 | 7,700 |
| Example 24 | $(Co_{0.90}Fe_{0.06}Ni_{0.02}Nb_{0.01}Mo_{0.01})_{75}Si_{10}B_{15}$ | 10,500 | 0.011 | 980 | 7,700 |
| Example 25 | $(Co_{0.90}Fe_{0.06}Ni_{0.02}Nb_{0.01}W_{0.01})_{75}Si_{10}B_{15}$ | 9,800 | 0.012 | 980 | 7,700 |
| Example 26 | $(Co_{0.89}Fe_{0.06}Ni_{0.02}Nb_{0.01}Mo_{0.01}Ta_{0.01})_{75}Si_{10}B_{15}$ | 11,200 | 0.013 | 990 | 7,500 |
| Example 27 | $(Co_{0.89}Fe_{0.06}Ni_{0.02}Nb_{0.005}V_{0.005}Ta_{0.005}Zr_{0.005}Mo_{0.005}W_{0.005})_{75}Si_{10}B_{15}$ | 9,500 | 0.014 | 970 | 7,000 |
| Example 28 | $(Co_{0.92}Fe_{0.06}Nb_{0.01}Cr_{0.01})_{75}Si_{10}B_{15}$ | 8,800 | 0.012 | 940 | 8,000 |
| Example 29 | $(Co_{0.92}Fe_{0.06}Nb_{0.01}Ta_{0.01})_{75}Si_{10}B_{15}$ | 9,400 | 0.014 | 980 | 8,100 |
| Example 30 | $(Co_{0.92}Fe_{0.06}Nb_{0.01}Ti_{0.01})_{75}Si_{10}B_{15}$ | 8,000 | 0.015 | 960 | 8,000 |
| Example 31 | $(Co_{0.92}Fe_{0.06}Nb_{0.01}Zr_{0.01})_{75}Si_{10}B_{15}$ | 7,900 | 0.015 | 960 | 8,000 |
| Example 32 | $(Co_{0.92}Fe_{0.06}Nb_{0.01}V_{0.01})_{75}Si_{10}B_{15}$ | 9,200 | 0.015 | 960 | 8,000 |
| Example 33 | $(Co_{0.92}Fe_{0.06}Nb_{0.01}Mo_{0.01})_{75}Si_{10}B_{15}$ | 9,300 | 0.013 | 980 | 8,000 |
| Example 34 | $(Co_{0.92}Fe_{0.06}Nb_{0.01}Mo_{0.01})_{75}Si_{10}B_{15}$ | 9,000 | 0.013 | 980 | 8,100 |
| Example 35 | $(Co_{0.91}Fe_{0.06}Nb_{0.01}Mo_{0.01}Ta_{0.01})_{75}$ | 9,400 | 0.013 | 980 | 7,800 |

-continued

| Sample | Composition | Permeability μ 1KHz | Coercive Force Hc (Oe) | Hardness Hv | Magnetic Flux Density $B_{10}$(G) |
|---|---|---|---|---|---|
| | PROPERTIES OF ALLOY | | | | |
| | $Si_{10}B_{15}$ | | | | |
| Example 36 | $(Co_{0.91}Fe_{0.06}Nb_{0.005}V_{0.005}Ta_{0.005}Zr_{0.005}Mo_{0.005}W_{0.005})_{75}Si_{10}B_{15}$ | 8,800 | 0.014 | 990 | 7,600 |
| Control 1 | $Co_{75}Si_{15}B_{10}$ | 970 | 0.030 | 690 | 7,500 |
| Control 2 | $(Co_{0.96}Fe_{0.04})_{75}Si_{10}B_{15}$ | 1,500 | 0.025 | 750 | 8,200 |
| Control 3 | $(Co_{0.94}Fe_{0.06})_{75}Si_{15}B_{10}$ | 5,800 | 0.021 | 710 | 8,500 |
| Control 4 | $Fe_{75}Si_{15}B_{10}$ | 680 | 0.058 | 710 | 14,000 |
| Control 5 | $(Co_{0.82}Fe_{0.08}Ni_{0.10})_{75}Si_{10}B_{15}$ | 850 | 0.032 | 690 | 7,800 |
| Control 6 | $(Co_{0.80}Fe_{0.06}Ni_{0.02}Nb_{0.12})_{75}Si_{10}B_{15}$ | 1,000 | 0.22 | 1,200 | 5,500 |
| Control 7 | $(Co_{0.48}Fe_{0.08}Ni_{0.40}Nb_{0.04})_{75}Si_{10}B_{15}$ | 1,500 | 0.043 | 850 | 4,100 |

The above table shows that the amorphous alloys falling within the scope defined in this invention exhibit prominent magnetic properties such as magnetic permeability and coercive force as well as prominent mechanical properties such as hardness.

Incidentally, the alloy of Control 3 is high in magnetic permeability but is unsatisfactory in hardness. Further, the mixing ratio of the components must be strictly adjusted for enabling the produced alloy to exhibit a high magnetic permeability as seen from comparison between Controls 2 and 3. Still further, the alloy of Control 3 is markedly inferior to the alloy of this invention in thermal stability as seen from FIG. 7.

EXAMPLE B

Figure 7:
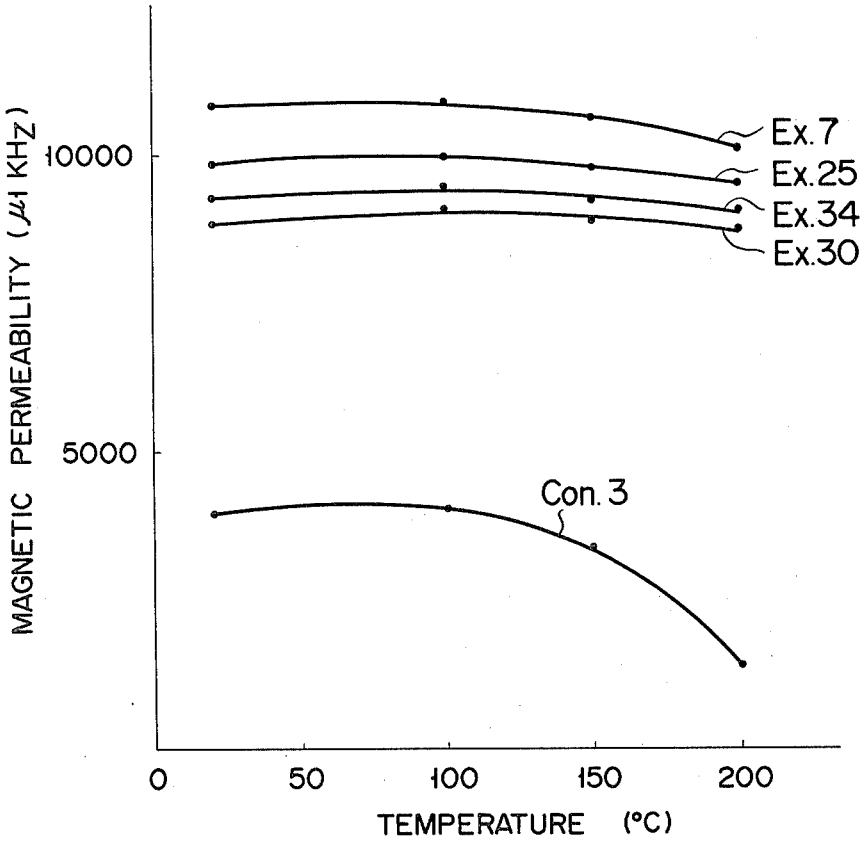
FIG. 7 is a graph showing the thermal stability of amorphous alloys of this invention in comparison with a conventional alloy.

Each of the amorphous alloys of Examples 7, 23, 28, 32 and Control 3 prepared in Example A was subjected to heat treatment for 1 hour at 100° C., 150° C. and 200° C. FIG. 7 shows the magnetic permeability of the alloy after the heat treatment. It is clearly seen that the amorphous alloy of this invention is prominently superior to the conventional amorphous alloy in thermal stability. Specifically, decrease of magnetic permeability is scarcely recognized in the alloy of this invention when heated to about 200° C. In contrast, marked decrease of magnetic permeability was observed after the heat treatment in the alloy of Control 3. Needless to say, thermal stability is very important because the magnetic material is exposed sometimes to heat of 100° to 150° C. in, for example, producing a magnetic head.

As described in detail, the amorphous alloy of this invention exhibits prominent magnetic properties such as magnetic permeability as well as prominent mechanical properties such as hardness and wear resistance. Naturally, the alloy of this invention is prominently effective when used for forming magnetic devices such as a magnetic head. It is also important to note that a heat treatment need not be applied to the alloy obtained by quenching method for enabling the alloy to exhibit excellent properties mentioned above. Further, the alloy of this invention covers a wide range of mixing ratios of the component metals, leading to a good reproducibility of the alloy.

What we claim is:

1. An amorphous alloy of high magnetic permeability, having the formula:

$$(T_yNb_xA_{1-x-y})_{100-z}X_z$$

wherein,

"A" is at least one element selected from the group consisting of 0.5 to 10 atomic % of V, Ta, Ti, Zr, Cr, Mo, W and 0.5 to 30 atomic % of Ni, based on the total amount of T, Nb and A, "T" is at least one element selected from the group consisting of Fe and Co, "X" is B or B+Si, the amount of Si being at most 25 atomic % based on the total amount of the alloy, "x" ranges between 0.005 and 0.1, "y" ranges between 0.5 and 0.99, and "z" ranges between 15 and 35, with the proviso that $0.005 \leqq 1-x-y \leqq 0.4$.

2. The alloy according to claim 1, wherein the component A is Ni.

3. The alloy according to claim 2, wherein the component T consists of both Co and Fe, the amount of Fe ranges between 4 and 9 atomic % based on the total amount of Co, Ni, Nb and Fe, the amount of Ni ranges between 1 and 15 atomic % based on the total amount of Co, Fe, Nb and Ni, the amount of Nb ranges between 1 and 10 atomic % based on the total amount of Co, Ni, Fe, and Nb, the component X consists of both Si and B, the amount of Si ranges between 5 and 17 atomic % based on the total amount of Co, Fe, Ni, Nb, B and Si, the amount of B ranges between 8 and 17 atomic % based on the total amount of Co, Fe, Ni, Nb, Si and B, and the value of "z" of the general formula ranges between 0.20 and 0.28, the alloy exhibiting a magnetic permeability of at least 4,400μ 1 KHz.

4. The alloy according to claim 3, wherein the amount of Ni is not more than 2 atomic % based on the total amount of T, Nb and Ni, the magnetic flux density of the alloy being more than 6,000 G under a magnetic field of 10 oersted in intensity.

5. The alloy according to claim 1, wherein the component A is at least one element selected from the group consisting of V, Ta, Ti, Zr, Cr, Mo and W.

6. The alloy according to claim 5, wherein the component T consists of both Fe and Co and the amount of Fe ranges between 3 and 8 atomic % based on the total amount of Co, Fe, Nb, V, Ta, Ti, Zr, Cr, Mo and W, the alloy exhibiting a magnetic permeability of at least 4,000μ 1 KHz.

7. The alloy according to claim 1, wherein the component A consists of Ni and at least one element selected from the group consisting of V, Ta, Ti, Zr, Cr, Mo and W.

8. The alloy according to claim 7, wherein the component T consists of both Fe and Co, and the amount of Fe ranges between 4 and 15 atomic % based on the total amount of Co, Fe, Ni, Nb, V, Ta, Ti, Zr, Cr, Mo and W, the alloy exhibiting a magnetic permeability of at least 4,000μ 1 KHz.

9. The alloy according to claim 8, wherein the amount of Ni is not more than 2 atomic % based on the total amount of Co, Fe, Ni, Nb, V, Ta, Ti, Zn, Cr, Mo and W, the magnetic flux density of alloy being at least 7,000 G under a magnetic field of 10 oersted in intensity.

* * * * *